US005102366A

United States Patent [19]

Huang et al.

[11] Patent Number: 5,102,366

[45] Date of Patent: Apr. 7, 1992

[54] ANIMATED TOY

[76] Inventors: Kun-Sen Huang; Hung-Chang Tseng, both of No.57 Chuang Ching Rd., Chung Ho City, Taipei Hsien, Taiwan

[21] Appl. No.: 634,385

[22] Filed: Dec. 27, 1990

[51] Int. Cl.[5] ..... A63H 13/00

[52] U.S. Cl. ..... 446/376; 40/411

[58] Field of Search ..... 446/269, 297, 376, 484; 40/411, 415

[56] References Cited

U.S. PATENT DOCUMENTS

| | | | |
|---|---|---|---|
| 530,870 | 12/1894 | Wenger | 40/411 |
| 932,875 | 8/1909 | Lavallée et al. | 40/411 |
| 1,263,211 | 4/1918 | Conrad | 40/411 X |
| 1,429,382 | 9/1922 | Vaughan | 40/411 X |
| 1,566,479 | 12/1925 | Horvath et al. | 40/411 |
| 3,820,265 | 6/1974 | Leonard | 40/411 |
| 4,157,630 | 6/1979 | Sawai | 446/484 X |

*Primary Examiner*—Robert A. Hafer
*Assistant Examiner*—Sam Rimell
*Attorney, Agent, or Firm*—Fleit, Jacobson, Cohn, Price, Holman & Stern

[57] ABSTRACT

An animated toy simulates a flying animal-drawn carriage with rider. The toy has a fixed toy body mounted on a first vertical transparent plate. Movable toy parts are carried by the toy body. A second vertically reciprocable transparent plate is mounted adjacent the first plate and is connected with an actuator mechanism within the toy body for operating the moving toy parts. The assembly of toy and plates is mounted in an ornamental box with transparent side walls.

13 Claims, 7 Drawing Sheets

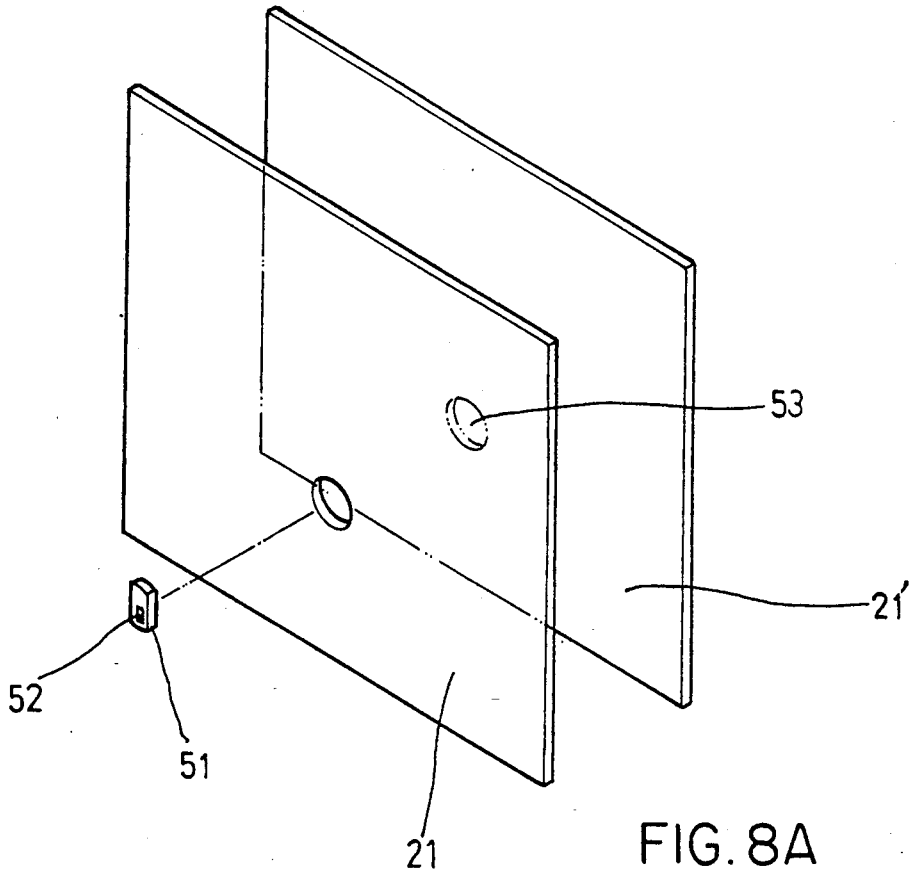
FIG. 8A
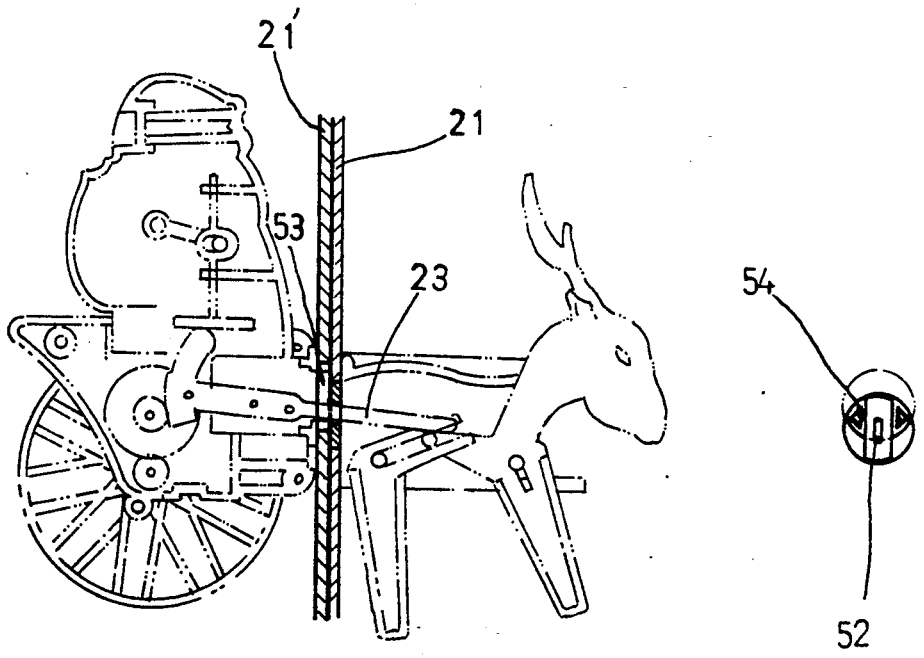
FIG. 8C
FIG. 8B

ANIMATED TOY

BACKGROUND OF THE INVENTION

This invention relates to an animated toy in an ornamental box and more particularly to a toy which simulates a flying object such as an animal-drawn carriage with a driver.

SUMMARY OF THE INVENTION

In accordance with the invention, an animated toy comprises a toy body carried on a fixed vertical transparent plate above a base. The toy body carries movable toy parts. A second vertically movable transparent plate is mounted adjacent the first plate and an actuator mechanism in the toy body connects the movable plate with the moving toy parts. A drive mechanism is provided in the base of the toy for reciprocating the movable plate up and down, thereby operating the movable toy parts to simulate a flying object. The toy may be accommodated in an ornamental box with transparent side walls and the drive mechanism may also rotate the box.

The flying article, simulated by the toy, may be an animal-drawn carriage and driver.

BRIEF DESCRIPTION OF THE DRAWINGS

The present invention will now be described by way of example, with reference to the annexed drawings, in which:

FIG. 8*a* is a perspective view of two supporting boards used for driving the toy;

FIG. 8*b* is an elevational view showing the relationship between the supporting boards and the toy; and FIG. 8*c* is an elevation view of the connecting rod assemblage.

DETAILED DESCRIPTION OF THE PREFERRED EMBODIMENT

Figure 1:
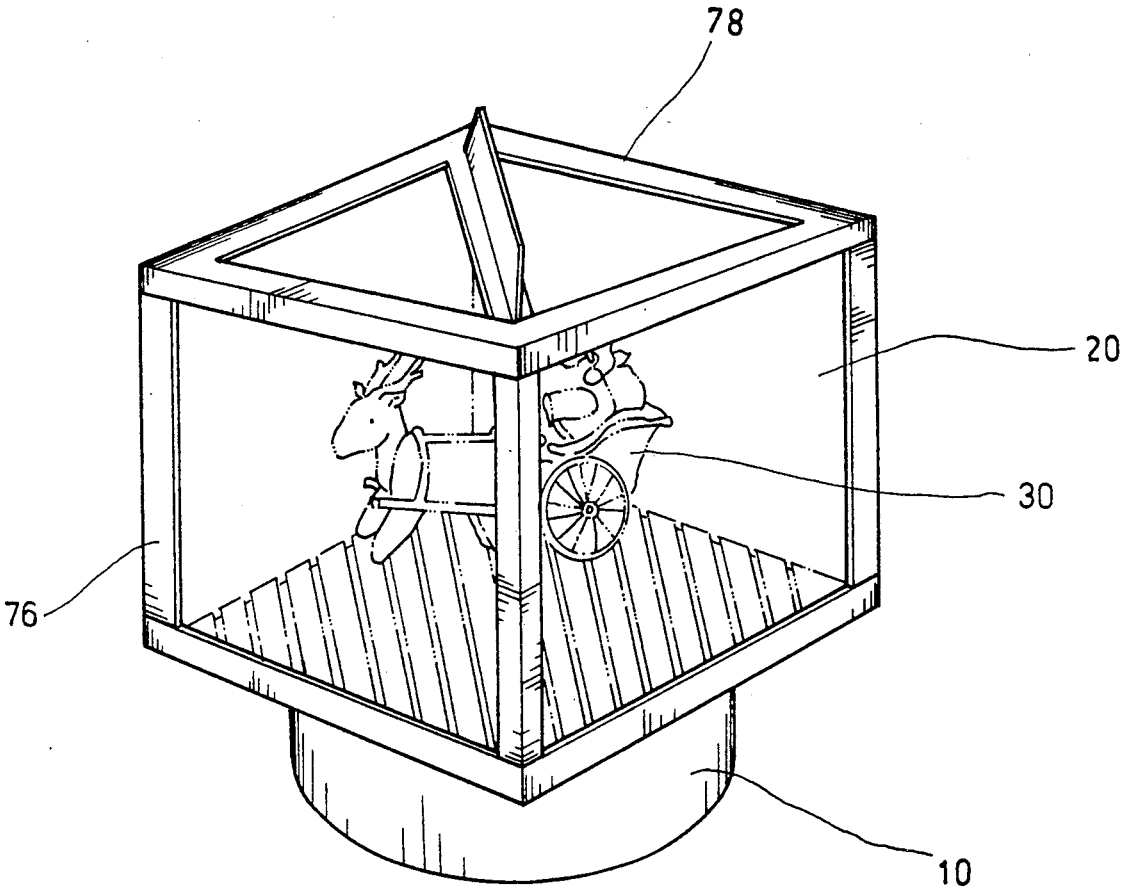
FIG. 1 is a perspective view of a preferred embodiment animated toy and box assembly of the present invention.
Figures 2A, 2B, 2C:
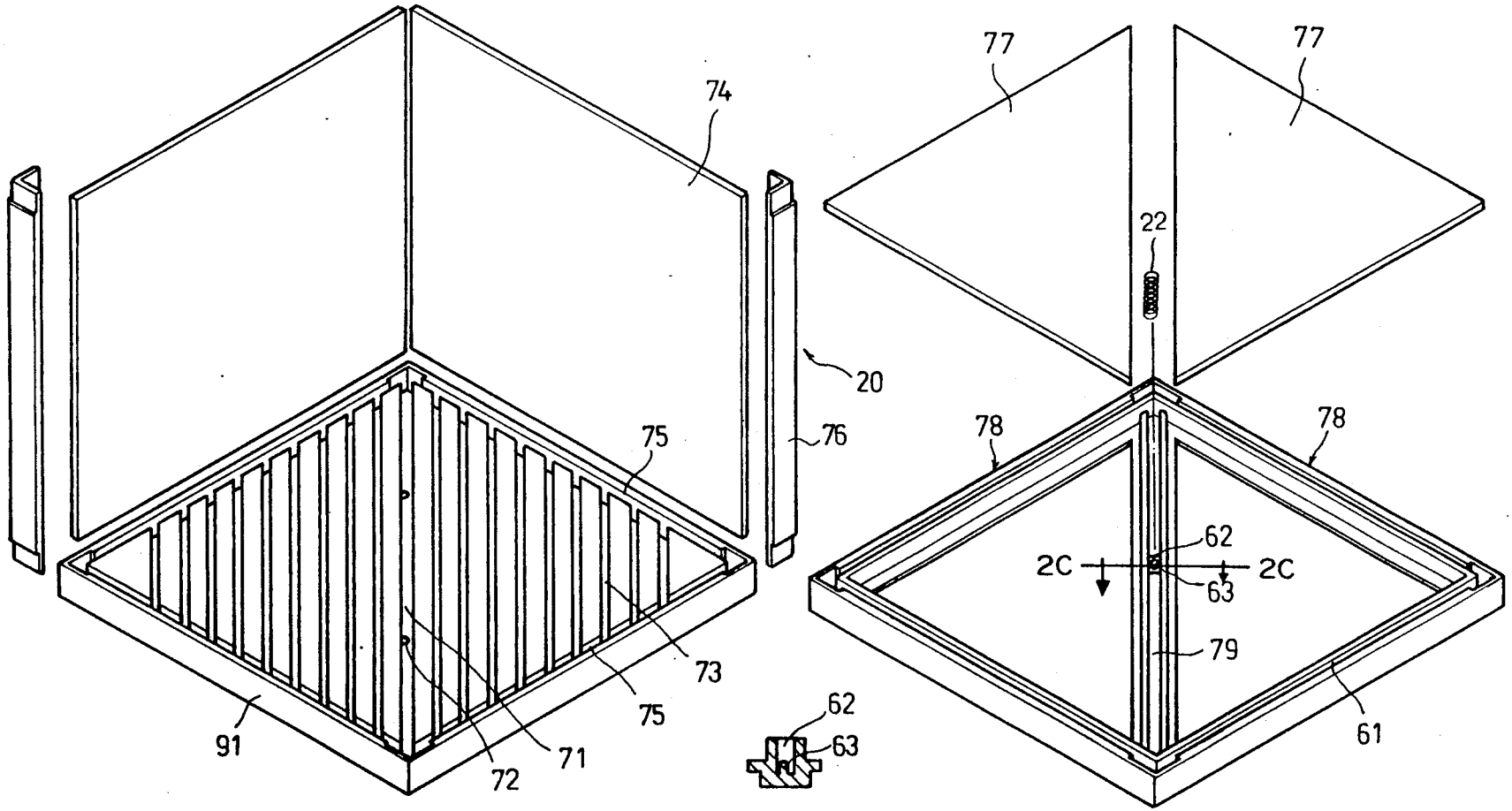
FIG. 2*a* is an exploded perspective view of the bottom and side sections of an ornamental box of the preferred embodiment toy.
FIG. 2*b* is an exploded perspective view of the top section of an ornamental box of the preferred embodiment toy.
FIG. 2*c* is a sectional view taken of 2C-2C of FIG. 2*b;*

Referring to FIGS. 1 and 2(a-c), an animated toy in an ornamental box according to the invention is generally comprised of a power transmission mechanism 10, a transparent box 20, and an animated toy driven by a mechanical mechanism 30. The power transmission mechanism 10 has an output terminal (push rods 94, FIGS. 5 and 6) for relatively reciprocating two transparent upright supporting boards or plates 21, 21' on which a toy carriage is mounted to provide animation of the toy inside the transparent box 20. When the power transmission mechanism 10 is turned on, the toy carriage is driven and, at the same time, the transparent box 20 is caused to rotate, while a sound generating device inside the power transmission mechanism 10 is simultaneously triggered to produce music. The toy carriage may be selectively embodied, for example, it can be a toy carriage with a toy deer to carry a toy Santa Claus as illustrated.

Figure 3:
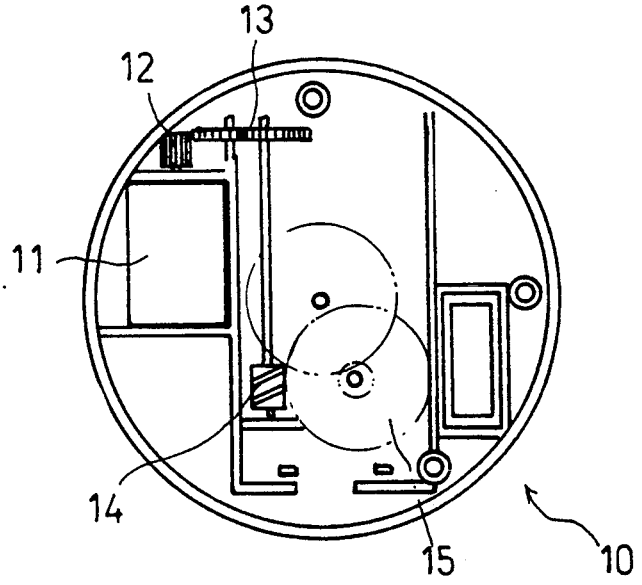
FIG. 3 is a plan view of a power transmission mechanism of the toy.
Figure 4:
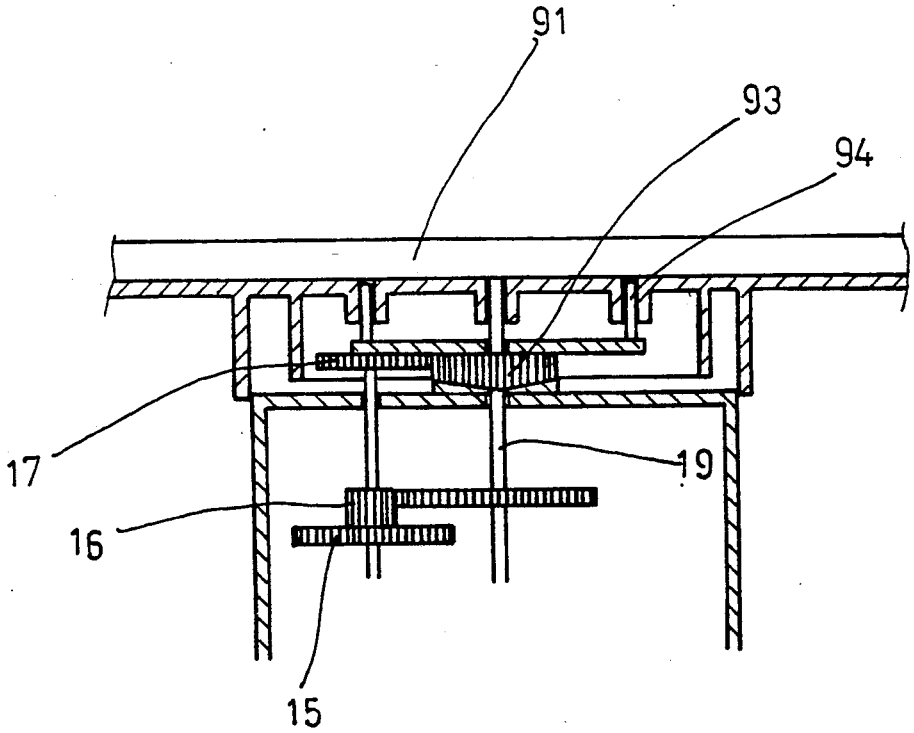
FIG. 4 is a longitudinal sectional view of the power transmission mechanism.

Referring to FIGS. 3 and 4, the power transmission mechanism 10 comprises a driving gear 12 carried by a motor 11 to drive a first gear wheel 13 and thus cause a second gear wheel 15 to rotate Via a worm 14, permitting a pinion 16 which is fixedly secured to the second gear wheel 15 for synchronous motion, to drive a third gear wheel 17. Gear wheel 17 meshes with a cam wheel 93 rotation of which causes the two push rods 94 to move up and down. During the rotary motion of the cam wheel 93, the wheel shaft 19 of the cam wheel simultaneously rotates a bottom board 91 of the box 20.

Figure 5:
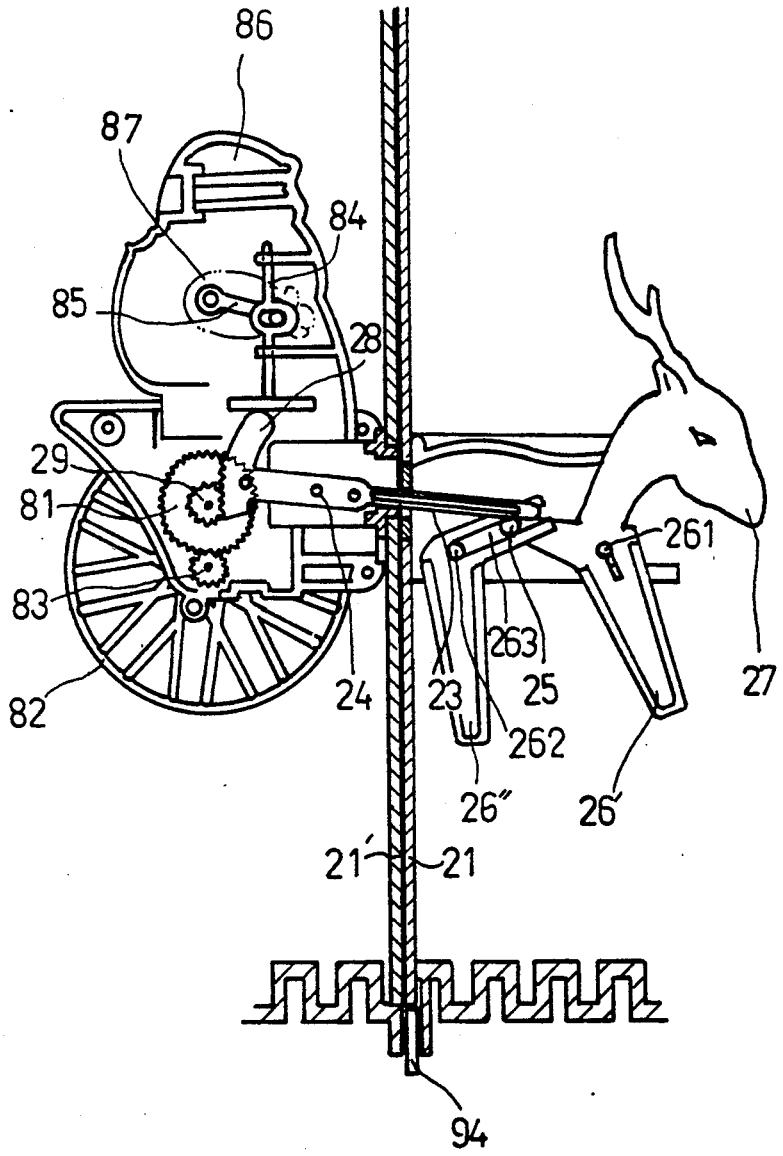
FIG. 5 is a sectional elevational view of the toy with push rods of the drive mechanism in a lower limit position.

As described above, the push rods 94 are driven by the cam wheel 93 to move up and down. Referring to FIG. 5, when the push rods 94 are moved to a lower limit position, the transparent, movable supporting board 21 carried on the push rods drops due to gravity and the spring force of a spring 22 in the lid of the box (see FIG. 2*b*). With downward movement of board 21, a transmission rod 23 in the toy carriage is pivoted on a supporting shaft 24 clockwise to reach a position shown in FIG. 5, and simultaneously to press down a drive axle 25 to open the legs 26' and 26'' of the toy animal, and causing the head 27 of the animal to lift. The front legs 26' and the head 27 of the toy animal are integrally made in a solid piece which is moved to rotate on a pivot 261 on the carriage which is fixed to board 21'. The rear leg 26'' has a slideway 263 supported on another pivot 262 on the carriage. Therefore, when the drive axle 25 is moved downward into the slideway 263, the front and rear legs 26' and 26'' are relatively moved to open. At the same time, the opposite end of the transmission rod 23 with a circular, toothed plate 28 moves upwards thereby rotating a small gear 29 and attached larger gear 81 to rotate a pair of carriage wheels 82 (in clockwise direction) via a driven gear 83. When the circular, toothed plate 28 is moved upwards, a supporting rod 84 is simultaneously moved upwards to cause a driven rod 85 to make a circular motion, so as to lift arms 87 of a toy driver 86 carried by the toy carriage.

Figure 6A:
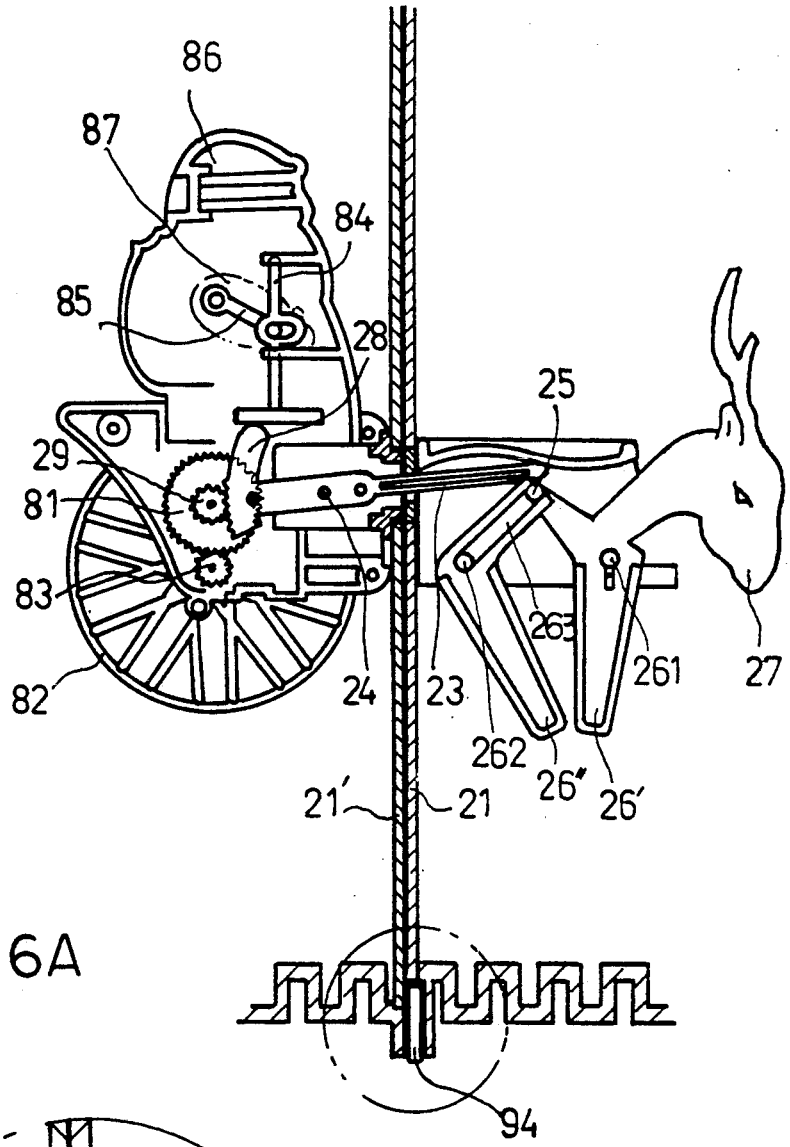
FIG. 6*a* is a sectional elevation view similar to FIG. 5 with the push rods in an upper limit position.
Figure 6B:
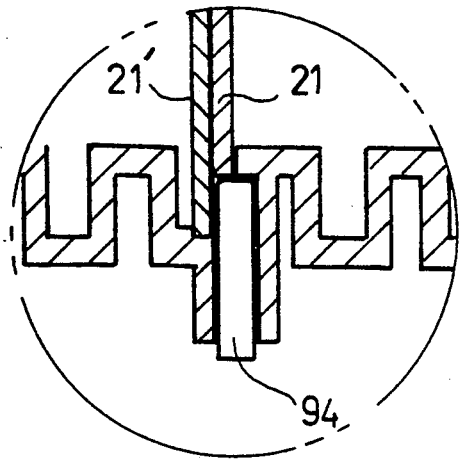
FIG. 6*b* is an enlarged sectional view taken on FIG. 6*a;*
Figure 7:
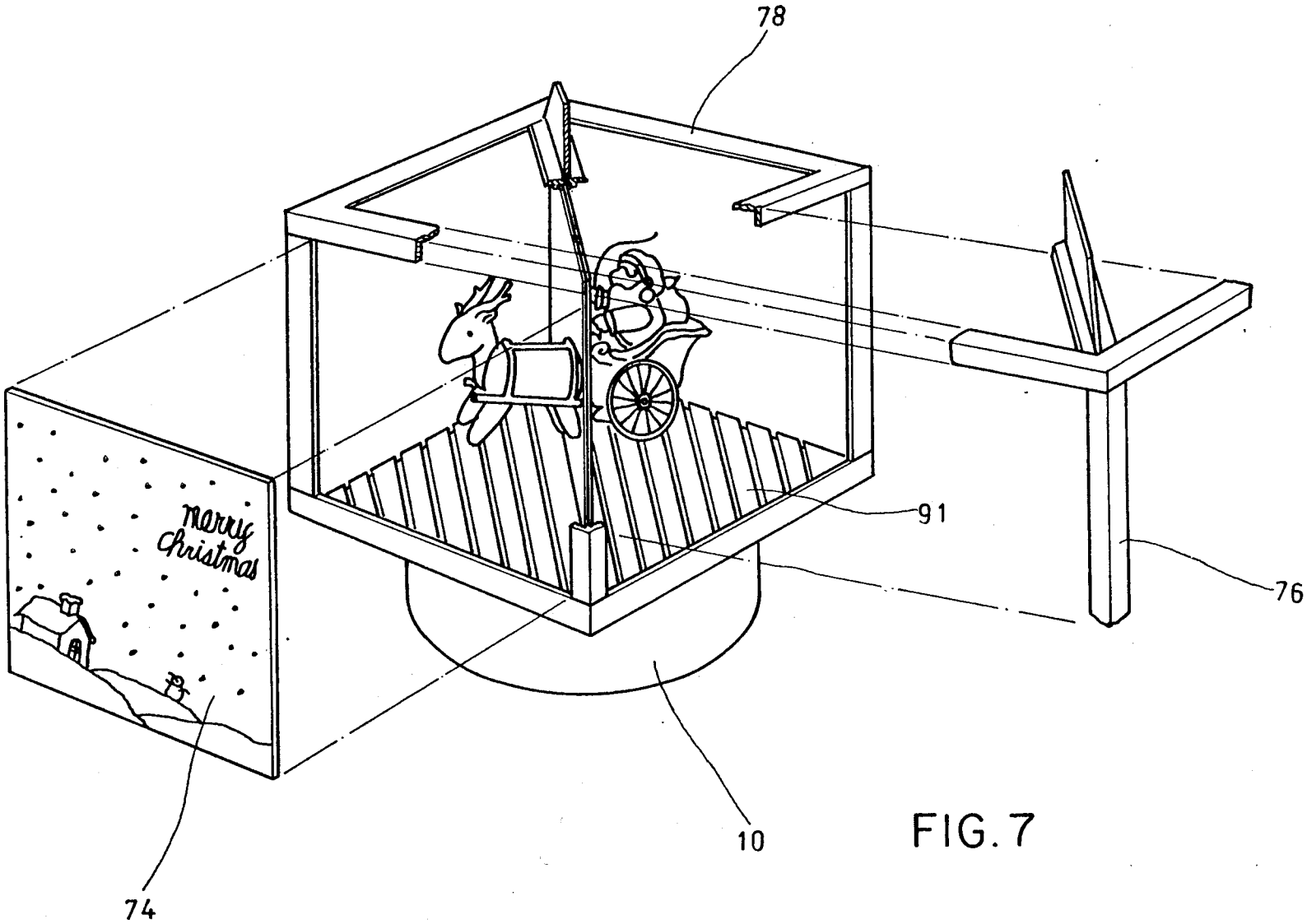
FIG. 7 is a perspective partly dismantled view of the toy and box assembly.

FIG. 6*a* illustrates the positioning of the part of mechanical mechanism 30 when the push rods 94 are moved to an upper limit position. When the push rods 94 are driven by the cam wheel 93 to the upper limit position, the transparent, movable supporting board 21 is lifted to compress the spring 22. The transmission rod 23 is pivoted on the supporting shaft 24 in a counter-clockwise direction, and therefore, the right end of the transmission rod 23 moved upwards to disengage from the drive axle 25 permitting the drive axle 25 to move upward, and therefore, the head 27 of the animal is permitted to fall (due to gravity) and simultaneously to force the front legs 26' to move closer to the rear legs 26''. At the same time, the left end of the transmission rod 23 is rotated downwards to pull back the circular, toothed plate 28 so as to rotate the carriage wheels 82 in a counter-clockwise direction via gears 29, 81 and the driven gear 83.

Thus, when the power transmission mechanism 10 is turned on, the head 27 and the legs 26' and 26'' of the toy animal are continually reciprocated and the carriage wheels 82 are continuously rotated, while the rider's arms 87 are rotated to simulate waving a whip. At the same time, the transparent box 20 is continuously rotated by the bottom board 91.

Referring to FIG. 8(a-c), the transmission rod 23 is inserted through a square hole 52 in a supporting block 51 secured to freely rotate within a round hole 53 through the transparent supporting boards 21 and 21'. The two transparent support boards 21 and 21' are closely attached together, so that the transparent supporting board 21 can be driven by the push rods 94 to move up and down relative to the other transparent support board 21''. Therefore, when the supporting block 51 is moved by the transparent supporting board 21, the supporting block 51 moves the transmission rod 23. The body of the toy animal is supported in position by a connecting rod 54 which is inserted through the round hole 53.

Referring to the dismantled view of the transparent box 20 as shown in FIG. 2, the bottom board 91 of the box 20 has a diagonal groove 71 in the center for mounting the transparent supporting boards 21 and 21', and a plurality of parallel grooves 73 on opposite sides of the diagonal groove 71 for ornamental purposes. The diagonal groove 71 has two through-holes 72 at two opposite ends offset from the center-line (see the detailed view in FIG. 6*b*) for insertion therethrough of the two push rods 94 to push the movable, transparent supporting board 21 to alternatively move up and down. The fixed, transparent supporting board 21' is firmly mounted in the diagonal groove 71 and closely attached to the movable, transparent supporting board 21. Thus, the movable, transparent supporting board 21 is movably mounted in the transparent box 20, while the fixed transparent supporting board 21' is fixedly secured in the transparent box 20.

In the preferred embodiment, the transparent box 20 is a square box having four transparent side boards 74 mounted on bottom board 91 at four sides around the periphery thereof. The bottom board 91 has a channel 75 at the top around the periphery thereof for mounting the four transparent side boards 74 and four colored ornamental supports 76 at the four corners thereof. There are two transparent, triangular boards 77 mounted on the top edge of the four side boards 74 and the four colored ornamental supports 76 and secured in position by a top frame 78. The top frame 78 has a diagonal groove 79 at the middle for holding the top edge of the transparent supporting boards 21 and 21', and a channel 61 around the periphery thereof for holding the top edge of the four side boards 74 and the four ornamental supports 76. There is a recess 62 made on the diagonal groove 79 of the top frame 78 at the center and a stopper 63 raised from said recess 62 at one side for holding the spring 22 which engages the top edge of the movable, transparent supporting board 21.

The bottom board 91, the ornamental supports 76 and the top frame 78 are colored the same dark color. Therefore, when the transparent box 20 is rotated, people will not be aware of the presence of the transparent supporting boards 21 and 21', and a simulation of a flying toy is present to a viewer.

We claim:

1. An animated toy comprising a base, a first transparent support fixed on the base, a fixed toy body carried by the first transparent support in an elevated position above the base, movable toy parts carried by the fixed toy body, a second transparent support mounted for vertical reciprocation on the base, an actuator mechanism within the toy body connected between the second support and the movable toy parts for providing reciprocation of the movable toy parts responsive to vertical reciprocation of the second support and simulating an article flying above the base, and drive means for providing vertical reciprocation of the second support.

2. A toy as defined in claim 1 wherein the first transparent support comprises a first substantially planar transparent plate and the second support comprises a second substantially planar transparent plate in juxtaposition adjacent the first plate.

3. A toy as defined in claim 2 wherein the toy body has a first fixed part extending outwardly from the first plate and a second fixed part extending from the second plate, the first and second parts being connected by rods extending outwardly through aligned first and second apertures in the respective plates.

4. A toy as defined in claim 3 wherein the toy has first movable parts carried by the first fixed part, second movable parts carried by the second fixed part and wherein the actuator mechanism includes a lever pivotally mounted in said toy body, the lever extending through said aligned apertures and having opposite ends for providing reciprocation of the first and second movable parts respectively.

5. A toy as defined in claim 4 wherein the lever extends through a support block in said second aperture providing a drive connection with the second transparent plate.

6. A toy as defined in claim 2 wherein the drive means includes vertically reciprocable push rods engaging a bottom edge of the second plate and a drive mechanism for moving the push fords up and down.

7. A toy as defined in claim 6 wherein the toy includes a casing with a cover enclosing the base and a spring between the cover and a top edge of the second plate to assist in lowering the second plate when the push rods are moved down.

8. A toy as defined in claim 6 wherein the drive mechanism for moving the push rods up and down comprises a cam plate rotatable about a vertical axis.

9. A toy as defined in claim 1 including a second drive means for rotating the base about a vertical axis.

10. A toy as defined in claim 4 wherein the first fixed part of the toy comprises a carriage with a drive rand the first movable parts comprise carriage wheels, wherein the second fixed part of the toy comprises an animal body and the second movable parts comprises the animal's front and back legs.

11. A toy as defined in claim 4 wherein said lever has a pin and slot drive connection with the animal's legs providing opening and closing movement of the front and back legs responsive to up and down movement of the second plate.

12. A toy as defined in claim 11 wherein said lever has a toothed segment and meshing gear drive connection with the carriage wheels for providing rotation of the wheels responsive to up and down movement of the second plate.

13. A toy as defined in claim 2 which includes a box with transparent side walls surrounding the toy body and plates, the box having a cover supporting upper edges of the plates.

* * * * *